US005890414A

United States Patent [19]

Powell

[11] Patent Number: 5,890,414

[45] Date of Patent: Apr. 6, 1999

[54] STOP CYLINDER AND PISTON ASSEMBLY

[75] Inventor: Allen C. Powell, Noank, Conn.

[73] Assignee: The United States of America as represented by the Secretary of the Navy, Washington, D.C.

[21] Appl. No.: 914,024

[22] Filed: Aug. 12, 1997

[51] Int. Cl.[6] ..... F01B 11/02

[52] U.S. Cl. ..... 92/85 R; 92/143; 92/163

[58] Field of Search ..... 92/85 R, 150, 92/151, 169.1, 143, 163, 152

[56] References Cited

U.S. PATENT DOCUMENTS

| | | | |
|---|---|---|---|
| 2,982,257 | 5/1961 | Fagge | 91/151 X |
| 3,176,590 | 4/1965 | Uhtenwoldt et al. | 92/151 X |
| 4,259,858 | 4/1981 | Freeman et al. | 92/85 R X |
| 4,406,215 | 9/1983 | Lacasse | 92/85 R |
| 4,748,894 | 6/1988 | Foster | 92/151 X |
| 5,351,763 | 10/1994 | Muuttonen | 92/85 R X |
| 5,361,680 | 11/1994 | Matsui | 92/151 X |
| 5,517,898 | 5/1996 | Kim et al. | 92/143 X |
| 5,522,302 | 6/1996 | Yuda et al. | 92/163 |

FOREIGN PATENT DOCUMENTS

| | | | |
|---|---|---|---|
| 197809 | 9/1978 | Germany | 92/85 R |
| 0840528 | 6/1981 | Russian Federation | 92/85 R |

*Primary Examiner*—Hoang Nguyen
*Attorney, Agent, or Firm*—Michael J. McGowan; James M. Kasischke; Prithvi C. Lall

[57] ABSTRACT

A stop cylinder and piston assembly has both a firing piston and a piston used for both firing and return located on the same piston rod. The stop cylinder and piston assembly is designed with gas passages so that gas injected for firing purposes through a single aperture in the sidewall of a cylinder is applied to the rear surface of both the firing piston and the piston used for both firing and return. The system is reset by injecting return gas through a second sidewall aperture that is applied to the forward surface of the return piston. A vessel bumper is installed in the forward end of a chamber containing the firing piston to provide cushioning for the firing piston upon being fired.

8 Claims, 1 Drawing Sheet

STOP CYLINDER AND PISTON ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to a stop cylinder and piston assembly. More particularly the invention provides a stop cylinder and piston assembly having increased output force and braking.

(2) Description of the Prior Art

The prior art stop cylinder and piston assembly includes a shaft having two separated pistons in which pressurized air is provided through a firing port to the aft surface of one of the pistons for firing purposes and pressurized air is provided through a return port to the forward surface of the other piston for return purposes.

In submarine launch tubes, an increased output force is essential at high ship speed due to hydrodynamic forces causing a weapon guide stud to excessively load a stop bolt cam. The weapon guide stud is a stud provided on a vehicle to be launched, such as a torpedo to prevent the vehicle from shifting in its launch tube prior to firing. The stop bolt cams interact with the weapon guide stud to prevent release of the vehicle until time of launch. The cams are driven by a gear rack mechanism attached to the stop bolt power cylinder. It was determined, if the prior art torpedo stop cylinder and piston assembly provided increased power to the stop bolt cams, the mechanism could release the weapon guide stud even at high ship speeds. In this usage, it is essential that the stop cylinder and piston assembly provide increased power. Improved braking of the piston is also desirable.

SUMMARY OF THE INVENTION

Accordingly, it is a general purpose and object of the present invention to provide an improved stop cylinder and piston assembly.

It is a further object that the device be compatible for use with state-of-the-art components in U.S. Navy vessels.

Other objects are that it provides increased output force and braking than prior art stop cylinder and piston assemblies.

These objects are accomplished with the present invention by providing a structure having a rod with a pair of pistons and applying gaseous pressure to the aft side of both pistons from a single source of gas, such as air, to drive the rod in a forward direction. The device is reset by applying gaseous pressure to the forward side of one of the pistons to move the rod and both pistons in the aft direction to the original position.

BRIEF DESCRIPTION OF THE DRAWINGS

For a more complete understanding of the present invention and the advantages thereof, reference is now made to the following description of the preferred embodiment taken in conjunction with the accompanying drawings in which.

DESCRIPTION OF THE PREFERRED EMBODIMENT

The drawings show the components necessary for an understanding of the present invention. They do not include all the components mentioned in the Description of the Prior Art.

Figure 1:
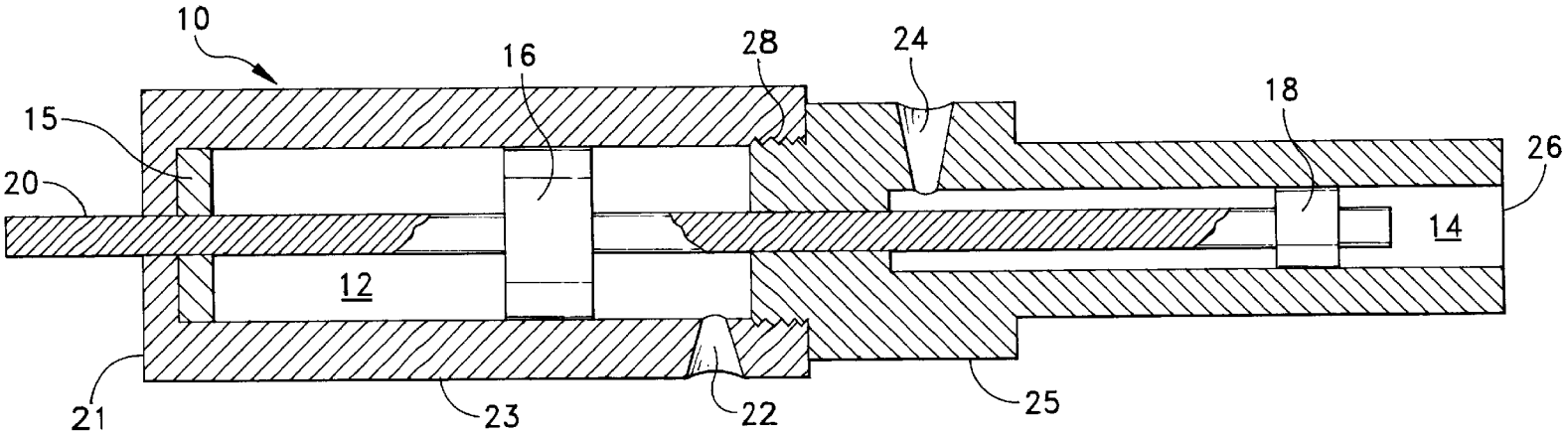
FIG. 1 (PRIOR ART)
FIG. 1 is primarily a sectional drawing with partial cutaway views of a prior art stop cylinder and piston assembly.

Refer now to FIG. 1 where there is shown a prior art stop cylinder and piston assembly 10. The stop cylinder and piston assembly 10 has a firing chamber 12 and a return chamber 14. A firing piston 16 is slidably positioned in firing chamber 12 and a return piston 18 is slidably positioned inside return chamber 14. A metallic bumper ring 15 is located at the forward end of firing chamber 12. A piston rod 20 extends between firing chamber 12 and return chamber 14 connecting the firing piston 16 to the return air piston 18. Both pistons 16 and 18 are threaded on piston rod 20; however, they can be affixed by other well-known means. Piston rod 20 also extends outside the forward end of firing chamber 12 through the forward wall 21 of cylinder housing piece 23. This is to enable the piston rod 20 to power an outside apparatus (not shown). A firing port 22 is formed in the sidewall of cylinder 23 of firing chamber 12 behind firing piston 16. A return port 24 is formed in a cylinder wall 25 of return chamber 14 forward of the return piston 18. The aft end of return chamber 14 is open to atmosphere providing access for assembly. Threads 28 connect the cylinder housing 23 to the cylinder wall 25.

In operation, pressurized gas is injected into firing chamber 12 through firing port 22. The pressurized gas acts on firing piston 16 to move the firing piston 16 in the forward direction which is toward the left in FIG. 1. During firing, due to the forward movement of return piston 18, gas is discharged through the return port 24. To reset firing piston 16, pressurized gas is injected into return port 24 to drive the return piston 18 toward the right or aft direction. This causes gas to be vented externally from firing chamber 12 through firing port 22.

Figure 2:
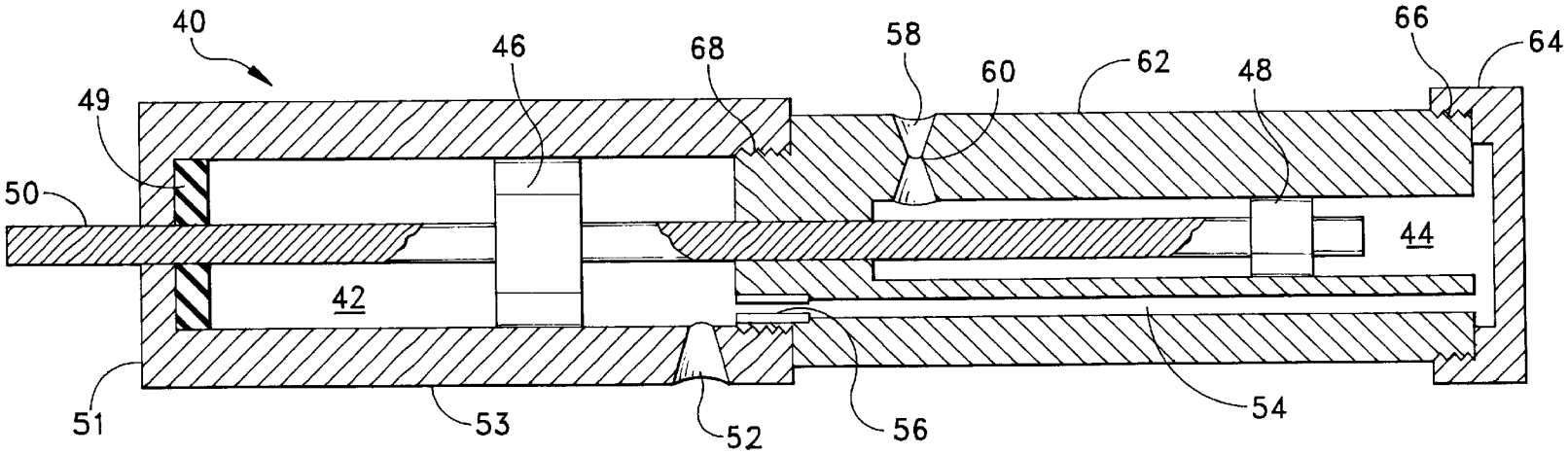
FIG. 2 is primarily a sectional drawing with partial cutaway views of a stop cylinder and piston assembly in accordance with the present invention.

Refer now to FIG. 2 for a description of a stop cylinder and piston assembly 40 in accordance with the present invention. The stop cylinder and piston assembly 40 has a firing chamber 42 and a chamber 44 acting in both the firing and return modes. A firing piston 46 is slidably positioned in the firing chamber 42 and a firing and return piston 48 is slidably positioned inside chamber 44. An elastomeric bumper 49 is positioned at the forward end of the firing chamber 42 to cushion the firing stroke of piston 46. The firing piston 46 and the return piston 48 are connected together by a piston rod 50. Both pistons 46 and 48 are threaded on the piston rod 50. However, the pistons 46 and 48 can be affixed by any well-known means to rod 50. Piston rod 50 also extends outside of firing chamber 42 through the forward wall 51 of firing cylinder-housing piece 53 to power an outside apparatus (not shown). A firing port 52 is formed in the sidewall of firing cylinder 53 to communicate with firing chamber 42 behind firing piston 46. A backside pressure duct 54 has a backside flow control orifice 56 positioned between return chamber 44 and firing chamber 42. The duct 54 enters return chamber 44 on the opposite side of return piston 48 from a return port 58 formed in a cylinder wall 62 of chamber 44. Return port 58 is fitted with a return flow control orifice 60. A cap 64 is affixed to the cylinder wall 62 at one end by threads 66. The cylinder wall 62 at its other end is connected to the firing cylinder 53 by threads 68.

In operation, for the firing of the cylinder 40, pressurized gas is injected into firing port 52. The pressurized gas acts to move the piston 46 in chamber 42 to the left. Additionally, pressurized gas is ported to the rear of return piston 48 through backside flow control orifice 56 and backside pressure duct 54 into return chamber 44. The action of the pressurized gas on return piston 48 produces power that is added to that produced on the piston 46 in chamber 42. During firing, due to the forward motion of piston 48, gas is discharged from return port 58 at the forward end of return cylinder 44, via return flow control orifice 60. The outflow restriction provided by the orifice 60 creates EL gas cushion, which acts to slow firing piston 46 and return piston 48 at the end of the stroke. Firing piston 46 is additionally provided with an elastomeric bumper 49 that reduces the impact of piston 46 at the forward end of chamber 42. To reset firing piston 46, pressurized gas is injected into the return port 58 to drive the return piston 48 to the right. This automatically discharges gas from chamber 44, at the backside of return piston 48 through backside pressure duct 54, fixed orifice 56, and the gas is vented externally through port 52.

There has therefore been described a torpedo stop cylinder and piston assembly 40 capable of providing 40% more power than the prior art torpedo stop cylinder and piston assembly 10 that it replaces, while providing improved braking. Both the prior art and newly invented stop cylinder and piston assemblies are substantially the same size.

It will be understood that various changes in the details, materials, steps and arrangement of parts, which have been herein described and illustrated in order to explain the nature of the invention, may be made by those skilled in the art within the principle and scope of the invention as expressed in the appended claims. For example, it is obvious that the assembly could be for either pneumatic or hydraulic use, and any pressurized fluid, either gaseous or liquid could be used as the working fluid in this assembly. Orifices 56 and 60 can be adjusted to provide the most desirable firing and braking characteristics. Furthermore, where pieces are affixed by threading, other means can be used to join them together.

What is claimed is:

1. A stop cylinder and piston assembly comprising:

a first hollow cylinder having a sidewall surrounding a chamber of a first predetermined diameter and a wall with a central aperture located at a forward end of said first hollow cylinder, said central aperture being of a second predetermined diameter that is smaller than said first predetermined diameter, an aft end of said first hollow cylinder being open to the full extent of said first predetermined diameter and a sidewall aperture located near the aft end of said first hollow cylinder;

a second hollow cylinder attached to the aft end of said first hollow cylinder, said second hollow cylinder having a sidewall surrounding a chamber of a third predetermined diameter and a wall with a central aperture of said second predetermined diameter located at a forward end of said second hollow cylinder, an aft end of said second hollow cylinder being open to the full extent of said third predetermined diameter, a sidewall aperture located near the forward end of said second hollow cylinder, and a pressure communication aperture extending in an axial direction through the sidewall of said second hollow cylinder so as to provide a passage between said chambers of said first and second hollow cylinders;

an end cap affixed to the aft end of said second hollow cylinder in such a manner as to leave an opening for the passage of air between said second hollow cylinder chamber and said pressure communication aperture;

a piston rod extending from outside the forward end of said first hollow cylinder to said second hollow cylinder;

a first piston affixed to said piston rod and located in said chamber of said first hollow cylinder; and a second piston affixed to said piston rod and located in said chamber of said second hollow cylinder.

2. A stop cylinder and piston assembly according to claim 1 further comprising:

said chamber of said first predetermined diameter having a larger diameter than said chamber of said third predetermined diameter.

3. A stop cylinder and piston assembly according to claim 2 further comprising an elastomeric bumper located within said first hollow cylinder adjacent said wall with said central aperture, said elastomeric bumper having a central aperture of substantially the same diameter as the central aperture of said wall.

4. A stop cylinder and piston assembly according to claim 2 wherein said stop cylinder and piston assembly is a pneumatic assembly.

5. A stop cylinder and piston assembly according to claim 2 wherein said stop cylinder and piston assembly is an hydraulic assembly.

6. A stop cylinder and piston assembly according to claim 2 wherein said sidewall aperture located near the forward end of said second hollow cylinder comprises an orifice restricting the release of gas pressure from the forward end of said second hollow cylinder thereby creating a gas cushion for slowing the operation of said first and second piston at the end of their stroke.

7. A stop cylinder and piston assembly according to claim 2 further comprising:

said first piston having an aft side that is in pressure communication with said sidewall aperture located near the aft end of said first hollow cylinder; and said second piston having an aft side that is in pressure communication with said sidewall aperture located near the aft end of said first hollow cylinder through said second communication aperture extending in an axial direction through the sidewall of said second hollow cylinder, and a forward side that is in pressure communication with said sidewall aperture located near the forward end of said second hollow cylinder.

8. A stop cylinder and piston assembly according to claim 1 wherein said end cap is threadably joined to said aft end of said second hollow cylinder.

* * * * *